United States Patent [19]

George

[11] 3,997,865

[45] Dec. 14, 1976

[54] ROTOR AND SHAFT BEARING MEANS FOR VARIABLE RESISTANCE CONTROL

[75] Inventor: Lee R George, Frankfort, Ind.

[73] Assignee: P. R. Mallory & Co., Inc., Indianapolis, Ind.

[22] Filed: July 17, 1975

[21] Appl. No.: 596,968

[52] U.S. Cl. ..... 338/174; 338/162; 338/171; 338/184

[51] Int. Cl.[2] ..... H01C 10/34

[58] Field of Search ..... 338/174, 202, 160, 162, 338/171, 184, 150, 152, 118, 128; 200/295, 296, 336; 74/10 R, 10 A, 22 R, 22 A

[56] References Cited

UNITED STATES PATENTS

| | | | |
|---|---|---|---|
| 2,712,583 | 7/1955 | Mucher | 338/171 |
| 2,899,662 | 8/1959 | Barden et al. | 338/174 |

*Primary Examiner*—C. L. Albritton
*Attorney, Agent, or Firm*—Hoffmann & Meyer

[57] ABSTRACT

Bearing surfaces are provided for a shaft and a rotor carried by the shaft as both are rotated against the base of a cup shaped member which forms part of the housing for a variable resistance control.

4 Claims, 1 Drawing Figure

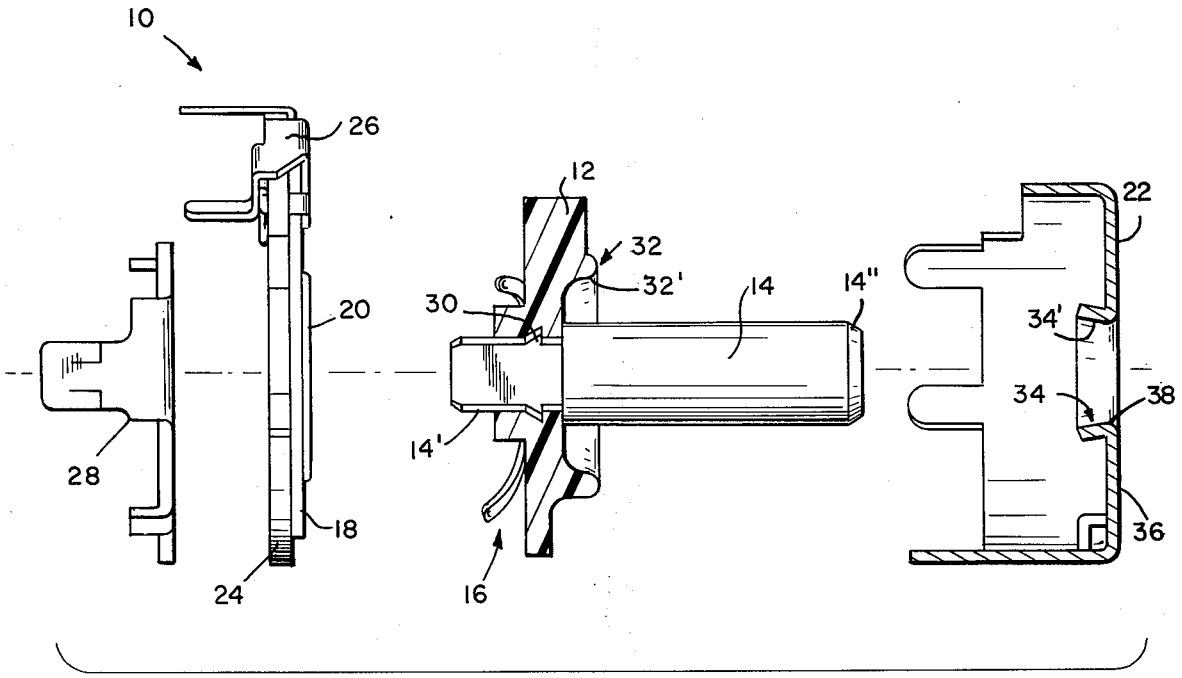
10
26
12
22
32
32'
14
14"
30
20
34'
34
38
28
14'
18
36
24
16

ROTOR AND SHAFT BEARING MEANS FOR VARIABLE RESISTANCE CONTROL

Generally speaking the present invention relates to an improvement in a variable resistance control having a cup shaped member and a base member closing same to provide a housing and wherein an electrical contact means rotates within the housing and electrically bridges a resistance element and a collector, both carried in the housing, the improvement comprising: a first bearing surface extending from a base of the cup shaped member, a rotatable shaft extending through an aperture in the base member and engaging the bearing surface, and a rotor fixedly connected to the shaft and carrying the electrical contact means, the rotor including a second bearing surface extending around at least a portion thereof and engaging the base of the cup shaped member.

The present invention pertains to a means of improving the manner in which a shaft and a rotor carried by the shaft rotate in a variable resistance control and more particularly to the manner in which the shaft and the rotor rotate against a housing of the control.

In variable resistance controls a shaft is rotated to turn a rotor, the rotor carrying electrical contacts to provide an electrical bridge between a resistance element and a common collector. Typical of such variable resistors is that described in U.S. Pat. No. 3,728,511 "Control With Rotor And Shaft Assembly" issued Apr. 17, 1973 to Lee R. George, et al which is incorporated herein by reference. As illustrated in the patent a shaft which carries a rotor is journalled in the base of a cup shaped housing at one end and rotates within a bushing member. There are many problems associated with such shaft arrangements such as: shaft rattle, maintaining close tolerances, dependable construction, and achieving a so-called "velvet touch" for good feel of the shaft and thus better control.

Accordingly it is a feature of the invention to provide an improved variable resistance control wherein better bearing surfaces are provided for a rotor and a shaft carrying the rotor. Another feature of the invention is the provision of such a control wherein a cup shaped member provides a housing for the control, the cup shaped member having a bearing surface extending from its bottom portion in which the shaft rotates. Another feature of the invention is to provide such a control wherein the rotor includes a bearing surface engaging the bottom portion of the cup shaped member. These and other features of the invention will be apparent from the following description taken in conjunction with the accompanying drawing wherein the sole FIGURE is an exploded view with portions broken away for clarity of a variable resistance control employing the features of the invention.

Referring to the drawing there is shown a variable resistance control 10 which in general includes a rotor 12 carried on a rotatable shaft 14, electrical contact means 16 carried by the rotor and which electrically bridges a resistance element 18 and collector 20. As shown in the above referenced U.S. Pat. No. 3,728,511, in controls such as these, the numerated elements are disposed within a housing, the housing being provided by a cup shaped member 22 and a base member 24 closing the same. As shown, both collector

20 and the resistance element are carried on the base. Also carried on the base are electrical terminals 26 which are in electrical contact with the resistance element and the collector. Also carried on the base is a mounting plate 28 for mounting the control to a panel. The description thus far is common to all such variable resistance controls used in the industry and is well known and understood in the art. Also, as is well known in the art, and as described in the afore-mentioned U.S. Pat. No. 3,728,511 rotation of shaft 14 through a knob (not shown) varies the resistance as the contact means 16 rotates over resistance element 18 and collector 20.

Rotor 12 is carried on shaft 14 by being fixedly connected to a reduced neck portion 14', the rotor being fixedly connected to the neck portion through at least one flared section 30 of the neck portion. Such method of attaching the rotor to the shaft is more completely described in the above-referenced U.S. Pat. No. 3,728,511.

According to the present invention better tolerances between the shaft and rotor and the various other elements of the device, as well as a "velvet feel" of the shafts rotation, is attained by providing bearing surfaces 32 and 34 for the rotor and the shaft. Bearing surface 32 includes ridge 32' unitarily constructed with the rotor and extending around the rotor. The ridge bears against the base 36 of the cup shaped member. Bearing surface 34 includes a flange 34' extending around an aperture 38 provided in the base 36 of the cup shaped member. The tapered end 14'' of the shaft engages the flange as the shaft is insert through the aperture.

The shaft is inserted through the aperture until, as noted previously, ridge 32' bears against base 36 of the cup shaped member. The outer surface of the shaft bears against at least a portion of flange 34' while ridge 32' bears against base 36.

What is claimed is:

1. In a variable resistance control having a cup shaped member and a base member closing same to provide a housing and wherein an electrical contact means rotates within said housing and electrically bridges a resistance element and a collector carried in said housing, the improvement comprising:

a. a first bearing surface extending from a base of said cup shaped member, b. a rotatable shaft extending through an aperture in said base member and engaging said first bearing surface, and c. a rotor fixedly connected to said shaft and carrying said electrical contact means, said rotor including a second bearing surface extending around at least a portion thereof and engaging said base of said cup shaped member.

2. In a variable resistance control according to claim 1 wherein said improvement further comprises an aperture in said base of said cup shaped member and wherein said first bearing surface includes a flange extending around said aperture.

3. In a variable resistance control according to claim 1 wherein said second bearing surface comprises a ridge unitarily constructed with said rotor and extending around said rotor.

4. In a variable resistance control according to claim 1 wherein a flared section extending around said shaft fixedly connects said rotor to said shaft.

* * * * *